US007641483B2

(12) United States Patent
Wei et al.

(10) Patent No.: US 7,641,483 B2
(45) Date of Patent: Jan. 5, 2010

(54) ELECTRONIC ASSEMBLY WITH FOLDABLE CONNECTOR

(75) Inventors: Jian Wei, Kunshan (CN); Xiao-Li Li, Kunshan (CN); Ping-Sheng Su, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/322,461

(22) Filed: Feb. 2, 2009

(65) Prior Publication Data

US 2009/0197442 A1 Aug. 6, 2009

(30) Foreign Application Priority Data

Feb. 1, 2008 (CN) ..... 2008 2 0031474 U

(51) Int. Cl.
*H01R 13/60* (2006.01)

(52) U.S. Cl. ..... 439/131

(58) Field of Classification Search ..... 439/131, 439/518, 172, 171, 170, 13, 31
See application file for complete search history.

(56) References Cited

U.S. PATENT DOCUMENTS 5,829,993 A * 11/1998 Wu ..... 439/131
5,895,294 A 4/1999 Delangis
5,967,807 A * 10/1999 Wu ..... 439/131
6,038,766 A 3/2000 Werner
6,461,198 B1 10/2002 Chao
6,551,142 B2 * 4/2003 Eisenbraun ..... 439/668
6,923,686 B1 * 8/2005 Cheng ..... 439/668
7,012,403 B2 * 3/2006 Hwang ..... 320/107
7,292,823 B2 * 11/2007 Kuo ..... 455/41.2
7,298,627 B2 * 11/2007 Hussaini et al. ..... 361/753
7,438,574 B2 * 10/2008 Neumann ..... 439/172

FOREIGN PATENT DOCUMENTS

TW 406884 9/2000

* cited by examiner

*Primary Examiner*—Neil Abrams
*Assistant Examiner*—Phuong Nguyen
(74) *Attorney, Agent, or Firm*—Ming Chieh Chang; Wei Te Chung; Andrew C. Cheng

(57) ABSTRACT

An electronic assembly (100) includes a housing having a plurality of walls together defining a receiving space and an outlet defined in one of the walls and in communication to the receiving space; a connector (53) pivotally linked to the housing and projected outward of the housing via the outlet; a locking member (6) mounted to the housing, said locking member including a base portion (60) having a first side and a second side opposite to the first side, a stopper portion (62) formed on the first side and extending into the receiving opening, and a resilient member (61) arranged adjacent to the second side for exerting a resilient force to the base portion.

18 Claims, 9 Drawing Sheets

ELECTRONIC ASSEMBLY WITH FOLDABLE CONNECTOR

FIELD OF THE INVENTION

The present invention generally relates to an electronic assembly, and more particularly to an electronic assembly with a foldable connector thereof. The invention relates to the copending application having the same title, the same filing date, the same applicants and the same assignee therewith.

DESCRIPTION OF PRIOR ART

As development of an electronic technique, an electronic device becomes lower profile and multifunction. Some consumer products, especially those video/audio products, should be equipped with a lower profile power port and signal port. For example, U.S. Pat. Nos. 6,461,198, 6,038,766, 5,895,294 and TW Pat. 406884 introduce some related art of electrical connectors.

U.S. Pat. No. 6,461,198 (hereinafter refer to U.S. '198) discloses audio connection apparatus. The connection apparatus includes plug and jack assemblies. The jack assembly defines a primary insertion hole and at least a pair of secondary insertion openings disposed laterally therefrom. The jack assembly includes a plurality of first conductive plates disposed in each of the secondary insertion openings. The plug assembly which releasably couples to the jack assembly includes a central shaft for engaging the primary insertion hole of the jack assembly in electrically conductive manner, as well as at least a pair of secondary insertions disposed laterally from the central shaft for respectively engaging the insertion openings of the jack assembly in electrically conductive manner. Each secondary insertion includes a plurality of second conductive plates each configured to contact a first conductive plate in electrically conductive manner. The engagement of the secondary insertions and secondary insertion openings enables the auxiliary transmission of electrical audio signals for supplementing the transmission of electrical audio signals through the engagement of the central shaft and primary insertion hole.

However, the plug assembly of U.S. '198 may be disposed outside of an electronic device, and it may occupy more space and be damaged by exterior environmental conditionals.

Hence, an improved electrical assembly is highly desired to overcome the aforementioned problems.

SUMMARY OF THE INVENTION

Accordingly, an object of the present invention is to provide an electrical connector capable of being retracted in a housing of an electronic assembly.

In order to achieve the object set forth, an electronic assembly in accordance with the present invention comprises a housing having a plurality of walls together defining a receiving space and an outlet defined in one of the walls and in communication to the receiving space; a connector pivotally linked to the housing and projected outward of the housing via the outlet; a locking member mounted to the housing, said locking member including a base portion having a first side and a second side opposite to the first side, a stopper portion formed on the first side and extending into the receiving opening, and a resilient member arranged adjacent to the second side for exerting a resilient force to the base portion; and the connector being pivotal to push the stopper member together with the base portion of the locking member against the resilient member to enter into the receiving space and be locked by the stopper member.

Other objects, advantages and novel features of the invention will become more apparent from the following detailed description when taken in conjunction with the accompanying drawings.

DETAILED DESCRIPTION OF PREFERRED EMBODIMENTS

Figure 1:
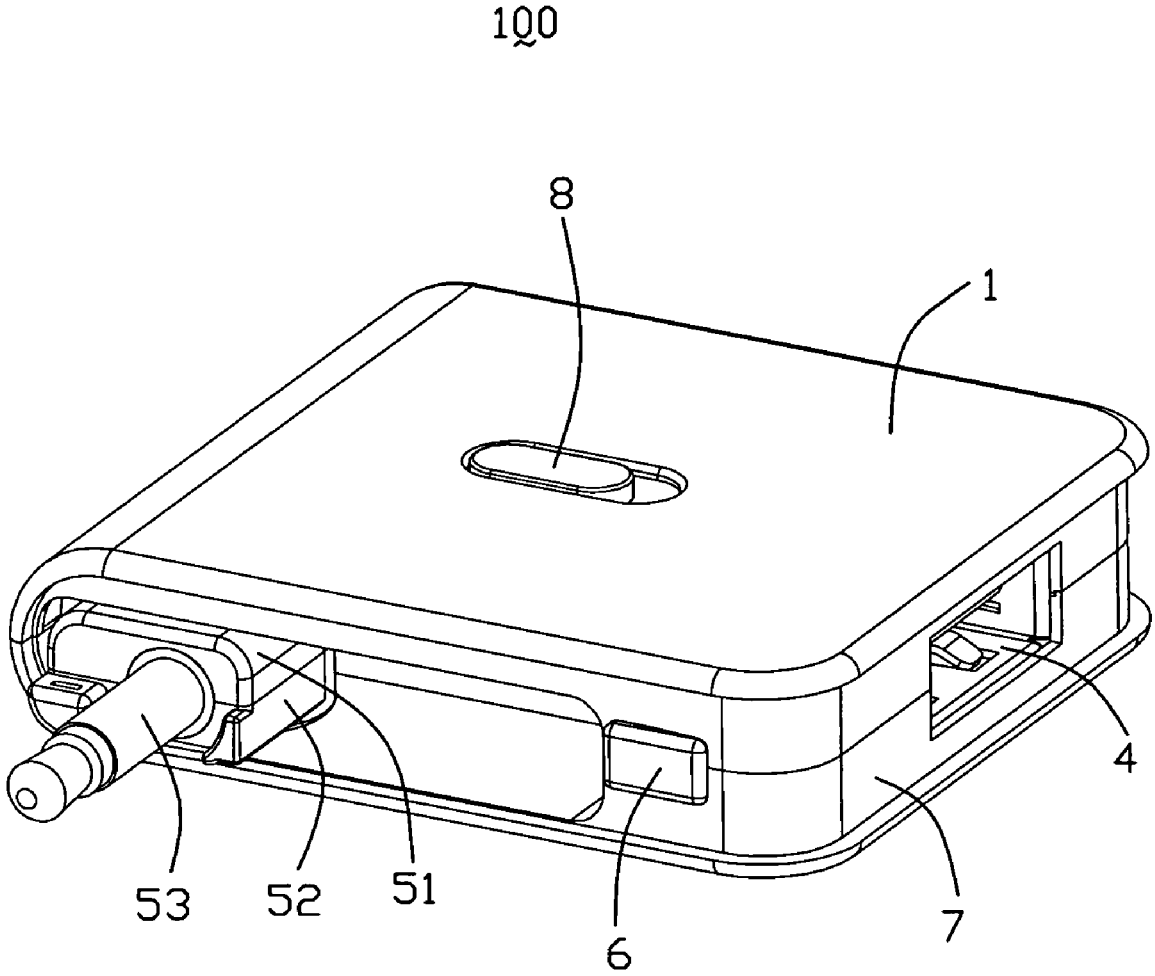
FIG. 1 is an assembled, perspective view of an electronic assembly, with a plug connector exposed outside of a housing thereof.
Figure 2:
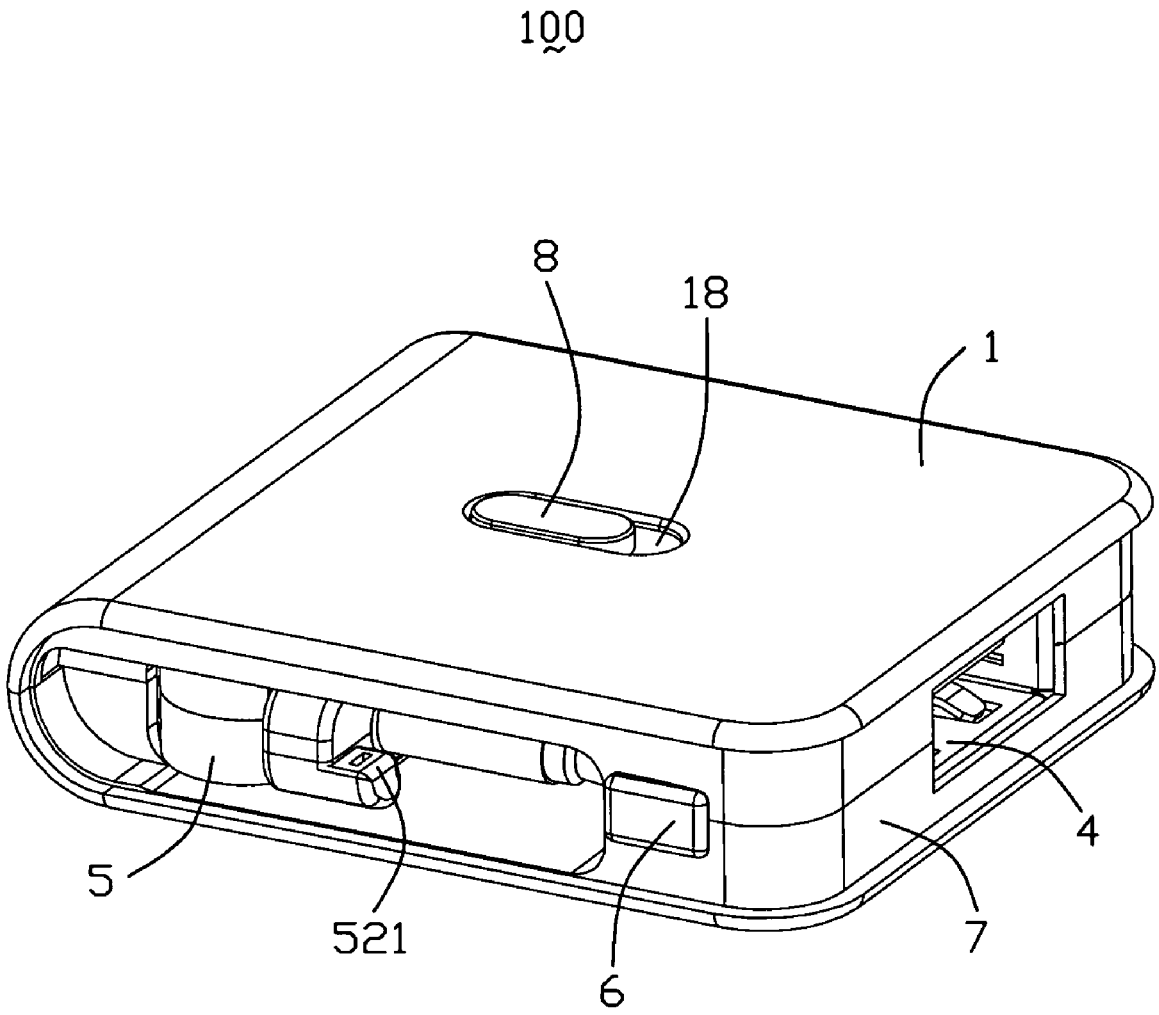
FIG. 2 is an assembled, perspective view of the electronic assembly, with the plug connector retracted into the housing.

Reference will now be made in detail to the preferred embodiment of the present invention.

Referring to FIGS. 1-4, an electronic assembly 100 comprises an up cover 1, a printed circuit board (PCB) 2, a first mating port 3 mounted to the PCB 2, a second mating port 4 arranged aside the PCB 2, a rotational member 5 mounted to a front section of the up cover 1, a locking member 6, and a bottom cover 7. The up cover 1 and the bottom cover 7 incorporated a housing for accommodating the aforementioned element members.

Referring to FIGS. 3-8, the up cover 1 includes a top wall 10, an arched first side wall 110 connected to a left edge of the top wall 10, a peripheral wall 112 extending downward from right and back edges of the top wall 10 and further connected to the first side wall 110. A first vertical wall 130, a second vertical wall 131, a third vertical wall 132 and a fourth vertical wall 134 are formed on an inner surface of the top wall 10 and interconnected one another to together form a rectangular shaped receiving area 13. A first opening 14 is defined in the right side of the peripheral wall 112 and aligns with the receiving area 13 transversally. Two first stoppers 141 are spaced apart one another and align with lateral sections of the first opening 14, and three second stoppers 142 are spaced arranged and proximate to a low edge of the first opening 14. A second opening 19 is defined in the back side of the peripheral wall 112, and a positioning post 12 is arranged aside the second opening 19. A platform 135 is located in the receiving area 13 and adjacent to the third vertical wall 132. The first vertical wall 130 is perpendicular to and has same height with the second vertical wall 131. Two extension portions 1321 extend laterally from ends of the third vertical wall 132 and substantially align with the first stoppers 141, respectively. Two L-shaped stoppers 136 are accommodated in the receiving area 13 and arranged adjacent to the second vertical wall 131 and the fourth vertical wall 134, respectively. The platform 135 is disposed adjacent to the L-shaped stopper 136 which is arranged aside the fourth vertical wall 134.

A slot 18 is recessed downwardly from an up surface of the top wall 10 of the up cover 1 and located above the platform 135. An rectangular shaped aperture 181 is defined in the middle section of the platform 135 and in communication to the slot 18. A cylindrical cavity 15 is located in the front segment of the inner side of the top wall 10, adjacent to the left side of the first side wall 110. An extension wall 153 is arranged on a top edge of the left side section of the cylindrical cavity 15 and has same height as the first side wall 110. A transversal connection wall 155 connects a front end of the extension wall 153 with an inner surface of the first side wall 110. A shaft 151 is located in the central section of the cylindrical cavity 15. Three positioning members 152 asymmetrically around the shaft 151, and one of the larger positioning members 152 and two of the smaller positioning members 152 are arranged at two lateral sides of the shaft 151, respectively. A passage 154 is located between the fourth vertical wall 134, the extension wall 153 and a back side section of the cylindrical cavity 15. A depression portion 156 is located in front of the transversal connection wall 155. A recessing portion 160 is arranged on an another side of the front segment of the inner side of the top wall 10. An upright wall (or supporting wall) 162 is arranged adjacent to the recessing portion 160 and connected to the fourth vertical wall 134 via an inclined transition wall (not numbered). A first cutout 1620 is defined in a lower section of the upright wall 162, and the first cutout 1620 has an oblique edge with respect to the transversal direction and a parallel edge with respect to the transversal direction. A third opening 161 is defined in an up section of the front segment of the peripheral wall 112.

Figure 5:
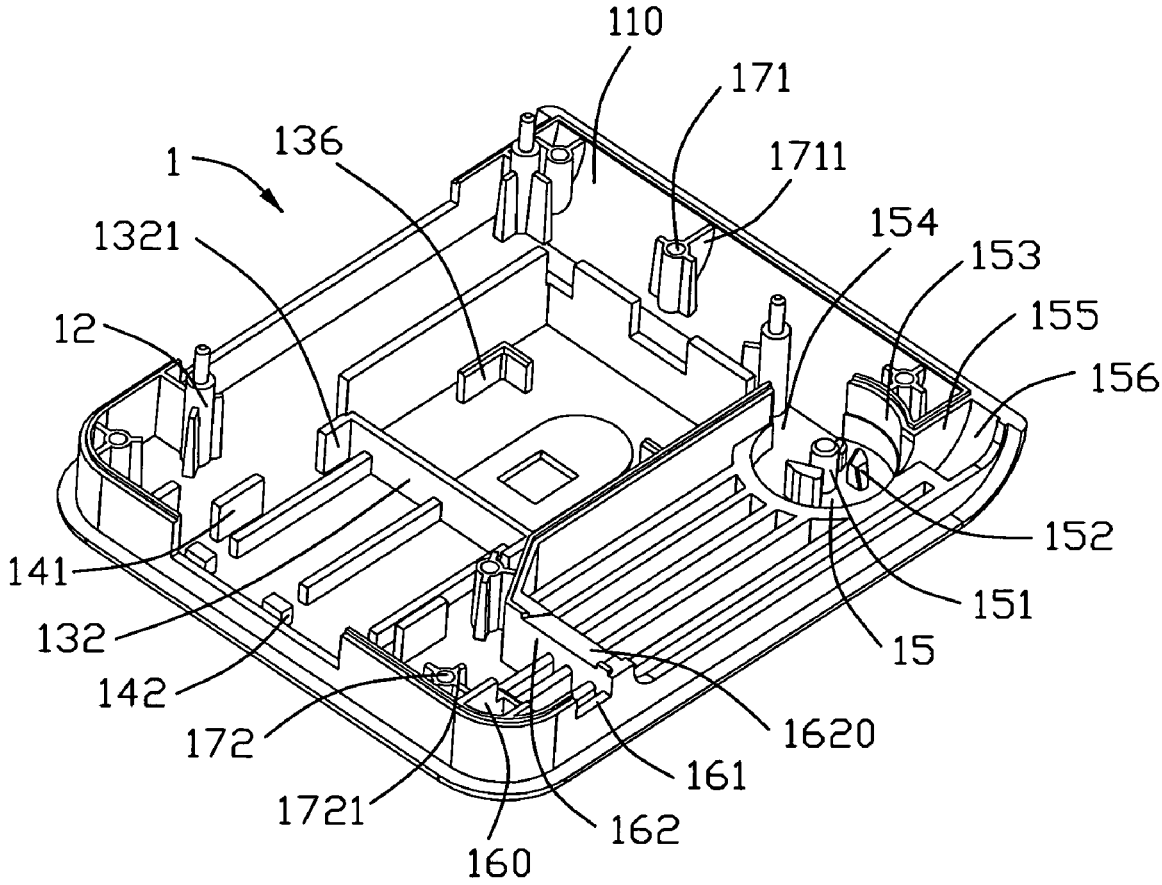
FIG. 5 is an up shell of the housing of the electronic device.
Figure 6:
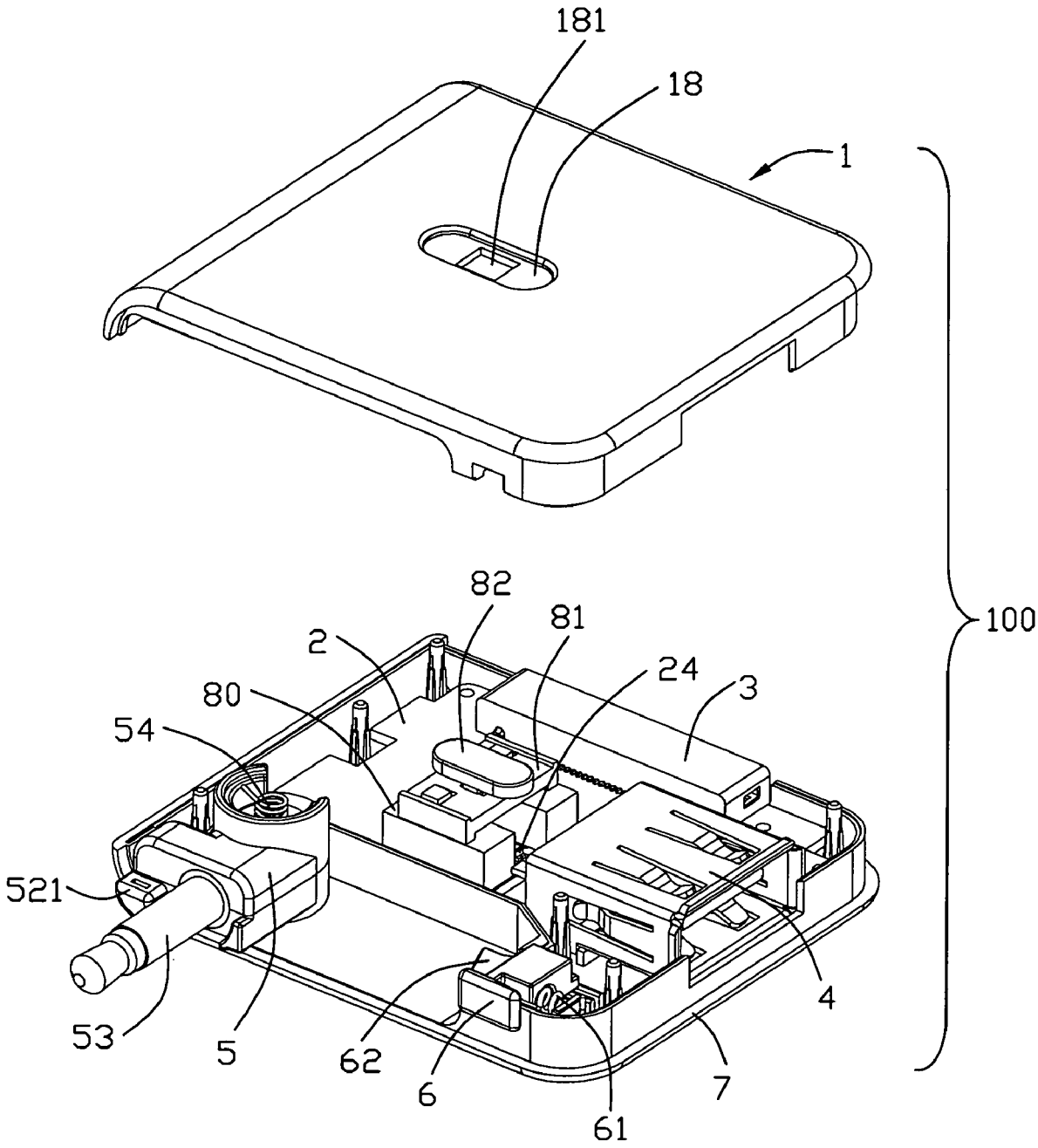
FIG. 6 is a partially assembled perspective view of the electronic assembly showed in FIG. 1, with the up shell remove away and the plug connector projecting outside of the housing.
Figure 7:
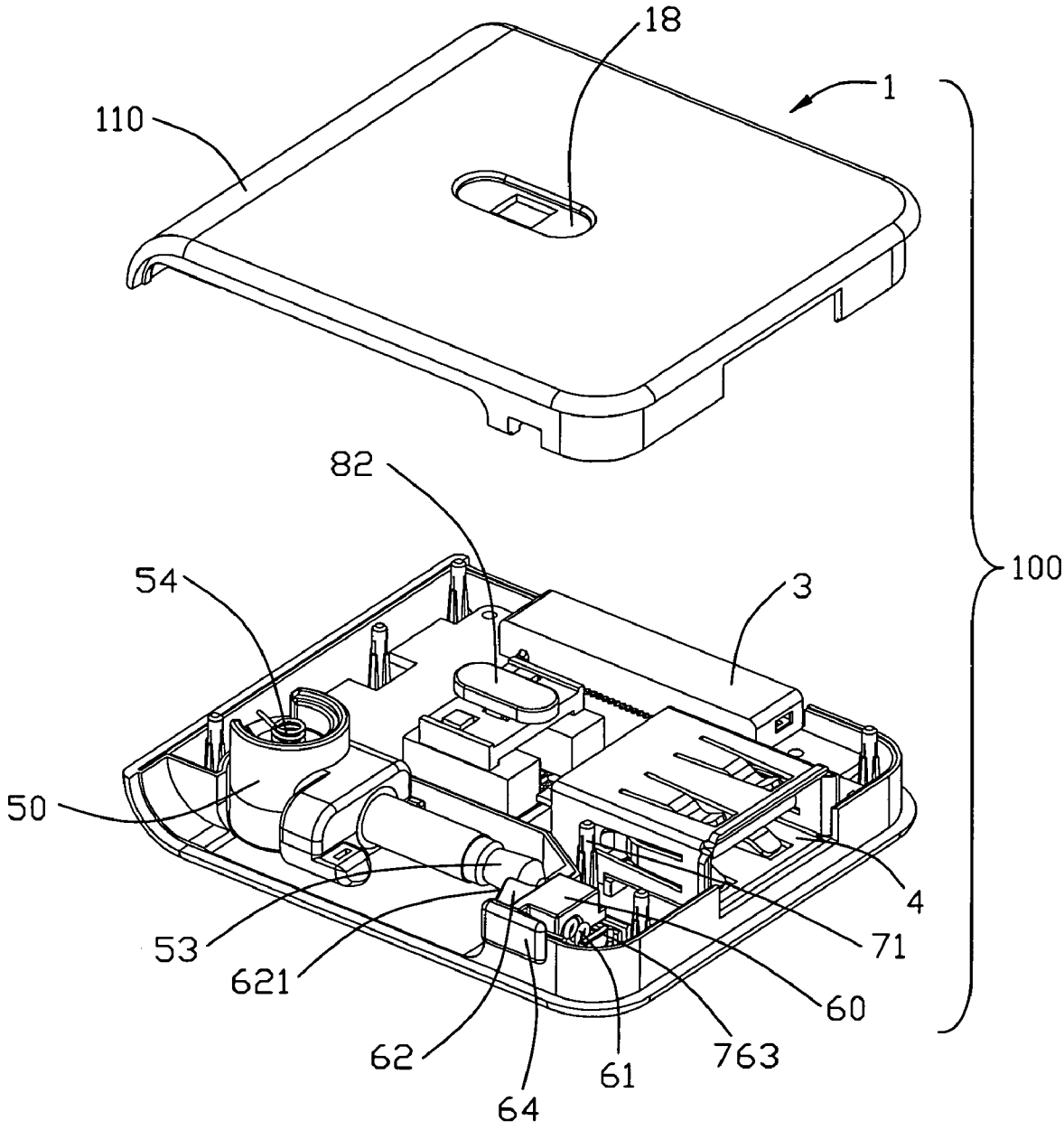
FIG. 7 is a partially assembled perspective view of the electronic assembly showed in FIG. 2, with the up shell removed away and the plug connector retracted into the housing.
Figure 8:
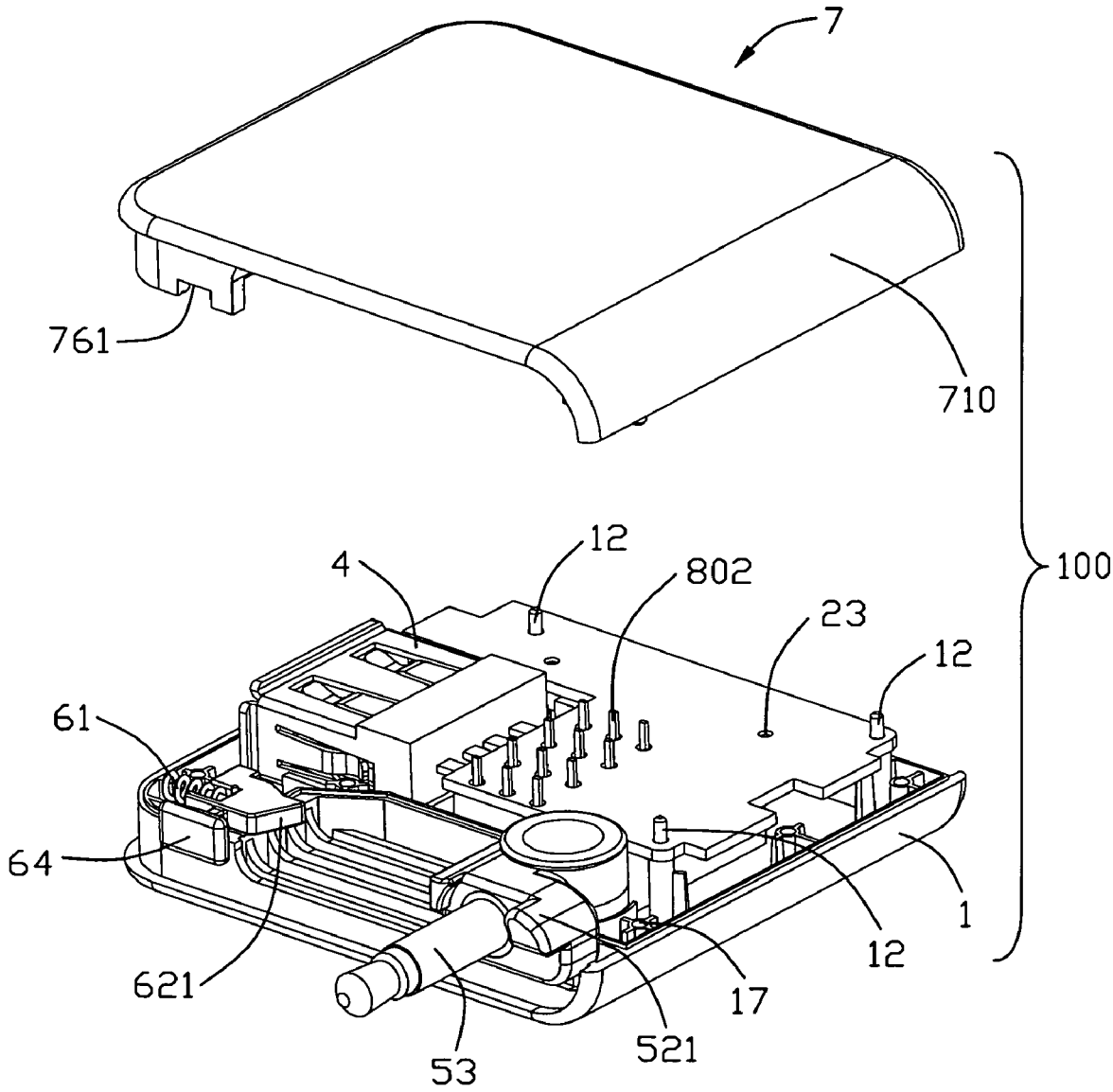
FIG. 8 is a partially assembled perspective view of the electronic assembly showed in FIG. 1, with the bottom shell removed away and the plug connector retracted into the housing.
Figure 9:
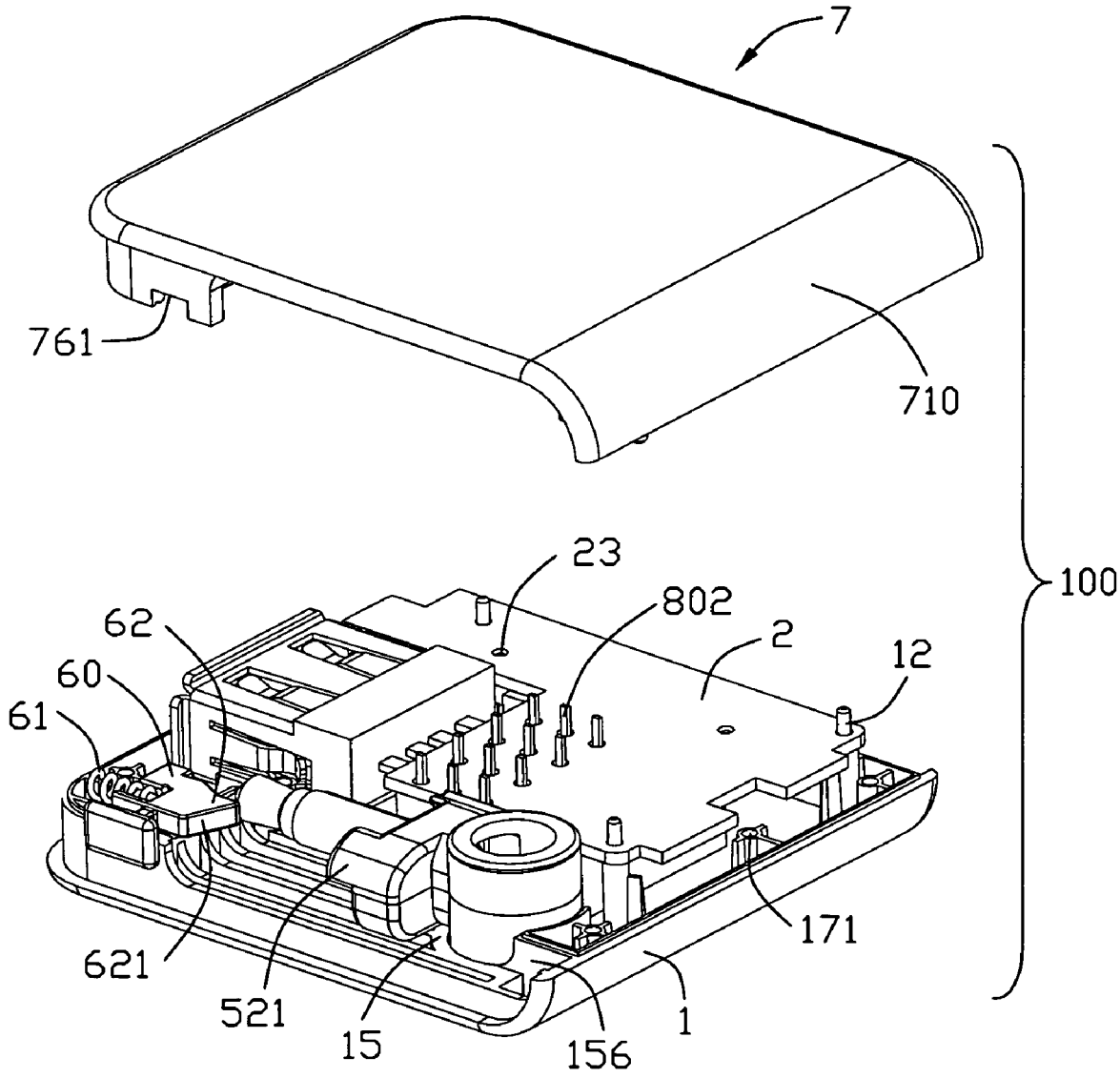
FIG. 9 is a partially assembled perspective view of the electronic assembly showed in FIG. 2, with the bottom shell removed away and the plug connector projecting outside of the housing.

Referring to FIG. 5, three second positioning holes 171 are spaced from one another and attached to an inner surface of the first side wall 110. Two third positioning holes 172 are arranged along the side section of the peripheral wall 112. Furthermore, a number of reinforcement portions 1711, 1721 are formed on outside of the first and second positioning holes 171, 172 and connected to the first side wall 110 and the side section of the peripheral wall 112.

Figure 3:
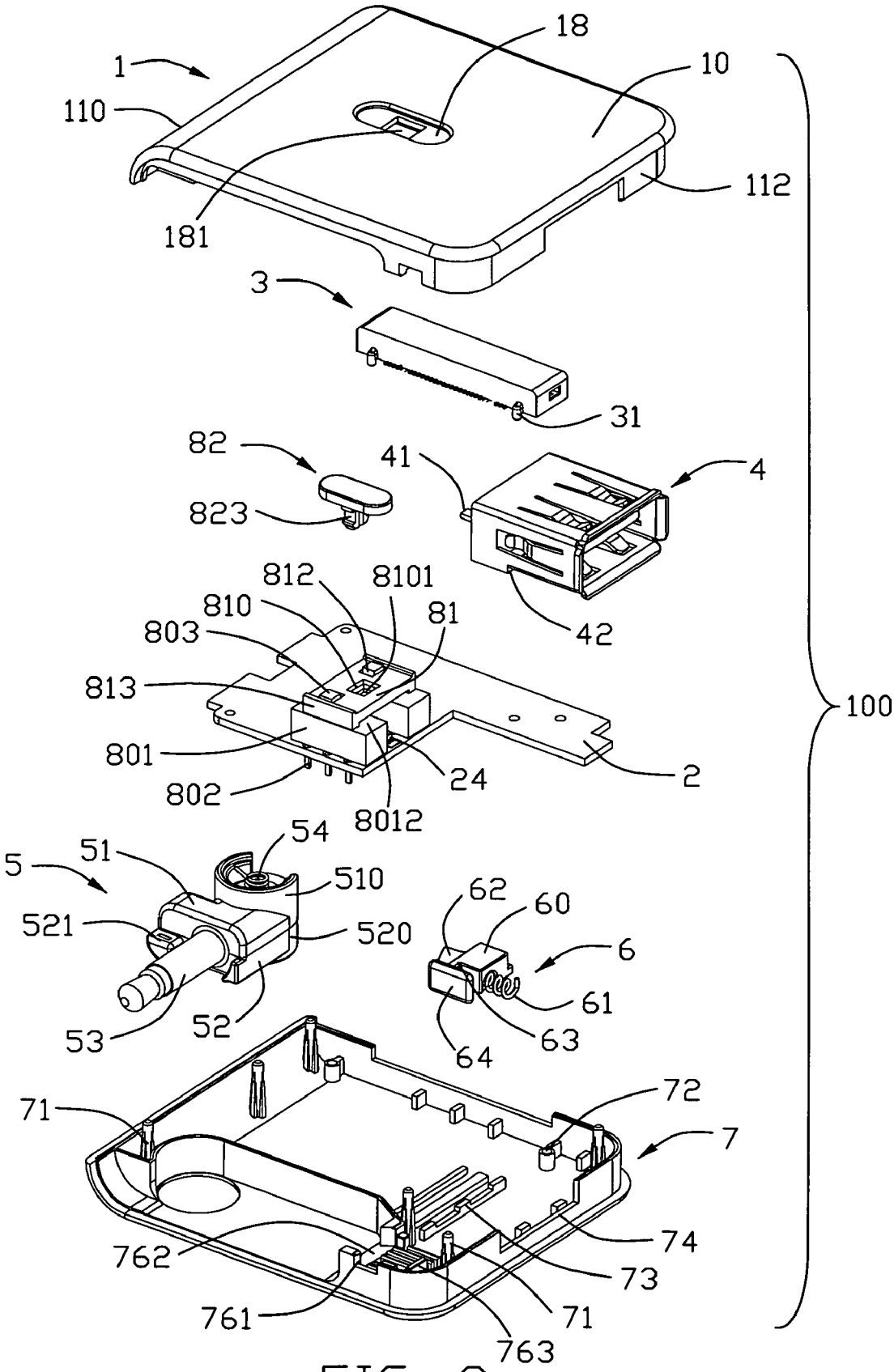
FIG. 3 is an exploded, perspective view of the electronic assembly.
Figure 4:
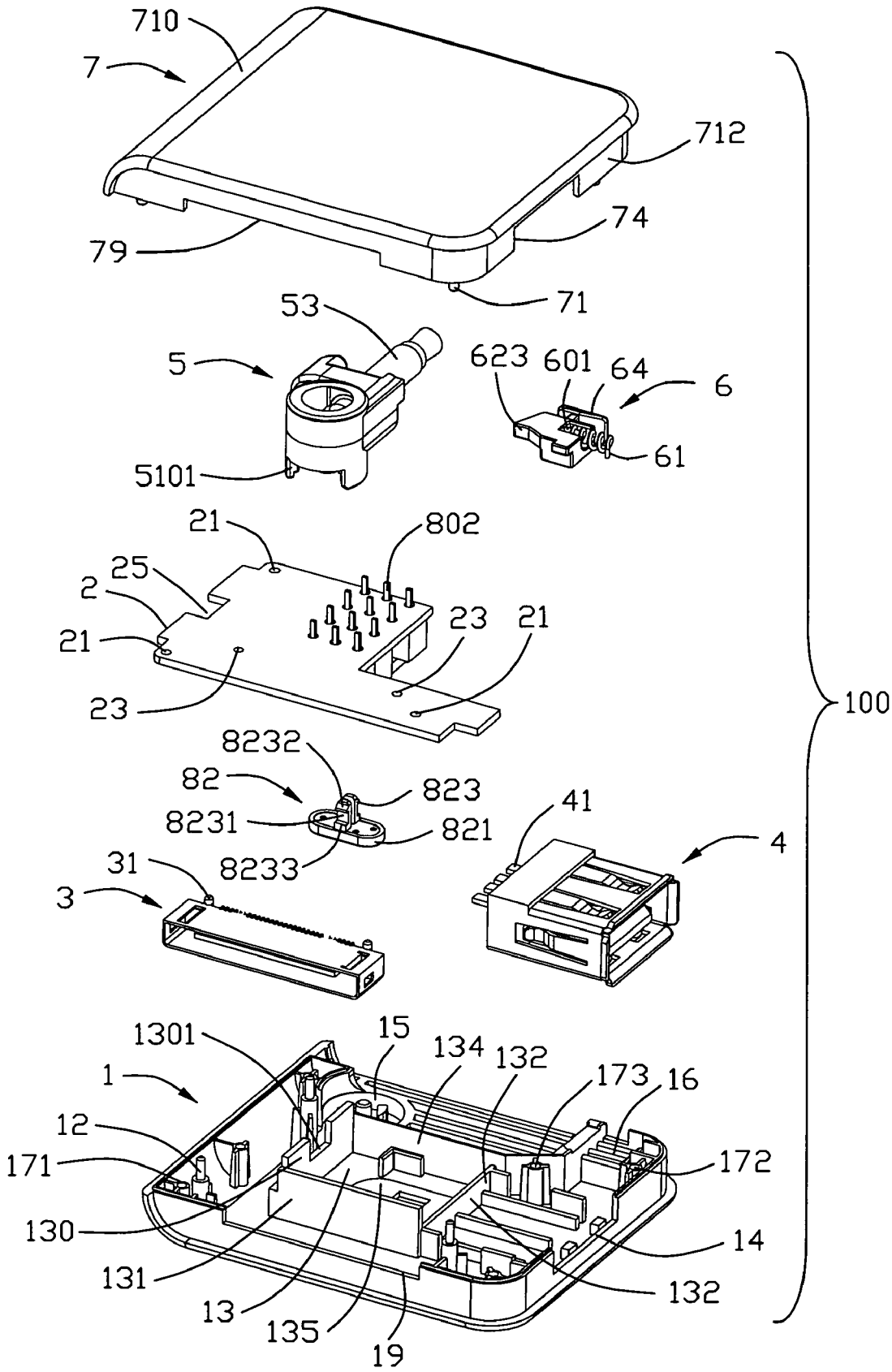
FIG. 4 is similar to FIG. 3, but viewed from another aspect.

Referring to FIGS. 3, 4, the PCB 2 is of L-shaped, and three first holes 21 are disposed in lateral sides thereof and two second holes 23 are defined in one of the longer lateral side. The first holes 21 are arranged proximate to outer edges of the PCB 2. A Light Emitting Diode (LED) 24 is mounted to the PCB 2 and the LED 24 is used for indicating running status of the electronic device. A cutout 25 is defined in the shorter lateral side of the PCB 2.

The first mating port 3 has thirty terminals 30 therein, and two positioning posts 31 are formed on a back surface thereof.

The second mating port 4 is a universal serial bus (USB) connector and has four terminals 41 therein. A protrusion portion 42 is formed on a rear section of the bottom surface of the second mating port 4.

The rotational member 5 includes a first base portion 51 and a second base portion 52 mounted onto the first base portion 51, with a rear portion of a plug connector 53 sandwiched therebetween. The first base portion 51 has a hollowed and cylindrical shaped engaging part 510 and a rectangular holding part (not numbered) attached to lateral side thereof. The second base portion 52 has a hollowed and cylindrical engaging part 520 and a rectangular holding part (not numbered) attached to lateral side thereof. A handling portion 521 extends forwardly from a front surface of the holding part of the second base portion 52 and is arranged aside the plug connector 53. The handling portion 521 is utilized for operating or swiveling the connector 53. A coil spring member 54 is assembled to interior portions of the engaging parts 510, 520 for providing a biasing function. A passageway 5101 is defined in a lower section of the engaging part 510 of the first base portion 51 and in communication to the interior portions of the engaging parts 510, 520. Wires (not shown) extend through the passageway 5101 and are coupled to the plug connector 53.

The locking member 6 includes a base portion 60, a resilient member 61 mounted to a first side (a right side) of the base portion 60, a stopper portion 62 formed on a second side (a left side) of the base portion 60 and opposite to the resilient member 61, and an operation member including a bar portion 64 parallel to a front surface of the base portion 60 and a neck portion (not numbered) connected the bar portion 64 and the base portion 60. The base portion 60 defines a mounting slot 601 for retaining the resilient member 61. The resilient member 61 may be a coil spring member or other types of spring members. The stopper portion 62 has a wedge shaped free end 623 which defines an inclined outward surface 621.

The electronic assembly 100 further has a switch device 8 which includes two supporters 80, an operation part 82 and a connection member 81 disposed between the supporters 80 and the operation part 82. The supporter 80 has a rectangular shaped main portion 801, a slider portion 803 mounted to an up surface 8012 and capable of sliding thereon, and three rows of soldering tails 802 extending downwardly from the main portion 801. The operation part 82 includes an ellipse shaped operation part 821, two juxtaposed engaging portions 823 extending downwardly from a middle section of a bottom surface of the operation part 821. The engaging portion 823 includes a notch 8231 defined in a middle segment of an outside thereof, a locking part 8232 formed at free end thereof, and a protrusion part 8233 attached to the bottom surface of the operation part 821. The connection member 81 is made of transparent material and configured to be I-shaped viewed from the lateral side. An aperture 810 is defined in a middle section of the connection member 81. Ribs 8101 are formed on interior side edges of the aperture 810. Two cavities 812 are defined in opposite side sections of the aperture 810 and proximate to a left side of the connection member 81. Two flange portions 813 are respectively attached to lateral ends of the connection member 81. An upper part of the flange portion 813 is thinner than a lower part of the corresponding flange portion 813. The cavities 812 are respectively disposed adjacent to the corresponding flange portions 813.

Referring to FIGS. 3, 6-9, the bottom cover 7 is substantially same as the up cover 1, and it has a second side wall 710 and a second peripheral wall 712 which are corresponding to the first side wall 110 and the first peripheral wall 112. A fourth opening 74, a fifth opening 79 and a six opening 761 are defined in the second peripheral wall 712 and corresponding to the first opening 14, the second opening 19 and the third opening 161 in the first peripheral wall 112. Three second positioning holes 71 are arranged along the second side wall 710 and align with the second positioning posts 171 of the up cover 1. A third positioning hole 72 is disposed adjacent to the fifth opening 79 and adapted for receiving the first positioning post 12. A number of bars 73 are formed on an inner surface of a low wall (not numbered), extending along a front-to-back direction and disposed adjacent to the fourth opening 74. A second cutout 762 is defined in an upper section of an upright wall (not numbered) perpendicular to the six opening 761. The second cutout 762 is same with the first cutout 1620, but deeper than the first cutout 1620. A second stopper 763 is arranged aside the six opening 761 and disposed adjacent to the lateral side of the second peripheral wall 712.

The soldering tails 802 under the supporters 80 are soldered to the PCB 2, and the two LEDs 24 disposed between the two supporters 80. The connection member 81 is mounted to the supporters 80. The slider portions 803 are respectively disposed in the cavities 812.

Referring to FIGS. 3-9, when assemble, positioning posts 31 of the first port 3 are inserted into the second holes 23 of the PCB 2, and contacts (not shown) of the first port 3 are soldered to the PCB 2. The terminals 41 of the second port 4 are electrically connected to the PCB 2 via some wires (not shown). The operation part 82 is assembled to the top wall 10 of the up cover 1, with the operation part 821 accommodated in the slot 18, the engaging portions 823 extending through the aperture 181, and the protrusion part 8233 of the engaging portions 823 abutting against the front and rear edges of the aperture 181. The first positioning posts 12 are inserted into the first holes 21. The engaging portions 823 further protrude into the aperture 810, with the locking parts 8232 thereof engaging with the ribs 8101 of the connection member 81. The switch device 8 is accommodated in the receiving area 13. The first port 3 is against the second vertical wall 131 and extend into the second opening 19. The second port 4 is arranged between the first stoppers 141, against the third vertical wall 132 and extend into the fourth opening 74.

The rotational member 5 is assembled to the up cover 1, with the passageway 5101 of the cylindrical engaging part 510 toward the passage 154 to have the wires connected to the plug connector 53 through the passage 154 and soldered to the PCB 2. The shaft 151 and the positioning members 152 are accommodated in the engaging parts 510, 520. The positioning members 152 further interfere with an interior side of the engaging part 510. The locking member 6 is also mounted to the up cover 7, with the stopper portion 62 projected into the second cutout 762, the neck portion extending into the six opening 761, the bar portion 64 exposed outside of the second peripheral wall 712, and the resilient member 61 proximate to the second stopper 763.

The bottom cover 7 is assembled to the up cover 1, with the second positioning posts 71 inserted into the second positioning holes 171. Therefore, the rotational member 5 and the locking member 6 are securely arranged between the up cover 1 and the bottom cover 7.

Referring to the FIGS. 1-2 and 6-9, the spring member 54 is capable of biasing or preloading a force to the rotational member 5 and thus plug connector 53 is exposed outside of the housing and perpendicular thereto. When the electronic device 100 is retracted into the housing, an exterior force exerted onto the base portions 51, 52, and the rotational member 5 pivots around the shaft 151, and the plug connector 53 presses onto the inclined surface 621 of the wedge shaped free end 623 to make the resilient member 61 compressed, and a free end of the plug connector 53 slides excessively inwardly and disposed behind the stopper portion 62, thus the plug connector 53 is locked by the stopper portion 62. When the plug connector 53 is used, just push the bar portion 64 moving laterally to make the free end 623 of the stopper portion 62 away from the plug connector 53, thus the plug connector 53 is exposed outside of the housing via a restore force by the spring member 54.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed:

1. An electronic assembly with foldable connector for video or audio products with a lower profile power port and signal port, comprising:

a housing, comprising an upper cover and a lower cover, having a plurality of walls together defining a receiving space and an outlet defined in one of the walls and in communication to the receiving space; two first stoppers aligning with lateral sections of a first opening, and a plurality of second stoppers spacing arranged to an edge of the first opening; another two stoppers arranged adjacent to two opposite vertical walls; a platform being disposed adjacent said another two stopper;

a switch device mounted on the upper cover, the switch device comprising an operation part, a slider portion, and a plurality of ribs;

a L-shaped printed circuit board having a plurality of first holes for assembling to the housing and a plurality of second holes for connecting the operation part;

a connector pivotally linked to the housing and projected outward of the housing via the outlet by a rotational member;

a locking member mounted to the housing, said locking member including a base portion having a first side and a second side opposite to the first side, a stopper portion formed on the first side and extending into the receiving space, and a resilient member arranged adjacent to the second side for exerting a resilient force to the base portion; and the connector being pivotal to push the stopper member together with the base portion of the locking member against the resilient member to enter into the receiving space and be locked by the stopper member.

2. The electronic assembly as recited in claim 1, wherein a mounting slot is defined in the second side of the base portion to retain the resilient member therein.

3. The electronic assembly as recited in claim 1, wherein the rotational member is combined with the connector and mounted to a circular cavity defined in a lateral section of the housing.

4. The electronic assembly as recited in claim 3, wherein the rotational member has cylindrical shaped engaging part received in the circular cavity.

5. The electronic assembly as recited in claim 4, wherein a shaft is arranged in the circular cavity and extends into a hollowed interior of the engaging part.

6. The electronic assembly as recited in claim 5, wherein three positioning members are asymmetrically disposed around the shaft and extend into the hollowed interior of the engaging part and interfere with the engaging part.

7. The electronic assembly as recited in claim 5, wherein the spring member is arranged in the hollowed interior of the engaging part to deflect the connector.

8. The electronic assembly as recited in claim 1, wherein the stopper portion defines a wedged free end with an inclined surface toward the outlet of the housing.

9. An electronic assembly with foldable connector for video or audio products with a lower profile power port and signal port, comprising:

a housing, comprising an upper cover and a lower cover, having a plurality of walls together defining a receiving space for accommodating an audio connector therein, and two first stoppers aligning with lateral sections of a first opening, and a plurality of second stoppers spacing arranged to an edge of the first opening; another two stoppers arranged adjacent to two opposite walls, a platform being disposed adjacent to said another two stopper; said connector pivotally engaged with the housing and capable of projecting outward of the housing through an opening defined in one of the walls by a rotational member;

a switch device mounted on the upper cover, the switch device comprising an operation part, a slider portion and a plurality of ribs;

a L-shaped printed circuit board having a plurality of first holes for assembling to the housing and a plurality of second holes for connecting the operation part;

a locking member mounted to the housing, said locking member including a base portion having a first side and a second side opposite to the first side, a stopper portion formed on the first side and extending into the receiving space for locking the connector, and a resilient member arranged adjacent to second side for exerting a resilient force to the base portion, and the operation member connected to the base portion for actuating the stopper portion to unlock the connector.

10. The electronic assembly as recited in claim 9, wherein a slot is defined in the one wall of the housing, and the operation member is arranged about the slot.

11. The electronic assembly as recited in claim 10, wherein the operation member includes a bar portion disposed outside of the slot, and a neck portion connected to the bar portion and projected into the slot and coupled to the base portion.

12. The electronic assembly as recited in claim 9, wherein a free end of the stopper portion has a wedged side facing to the opening of the housing.

13. The electronic assembly as recited in claim 11, wherein the printed circuit board is accommodated in the receiving space and arranged aside the connector.

14. The electronic assembly as recited in claim 13, wherein the switch device is supported by the printed circuit board.

15. An electronic assembly with foldable connector for video or audio products with a lower profile power port and signal port, comprising:

a case defining a rectangular interior space communicating with an exterior on thereof first, second and third sides neighboring with one another;

a printed circuit board received in said interior space;

first and second connector respectively disposed around the first side and the second side to communicate with the exterior;

a third connector, which is configured with a columnar plug, located around the third side and moveable between first and second positions wherein said third connector is retracted and hidden behind the third side in the first position while is extended and exposed to the exterior in the second position to replace one of said first connector and said second connector for electrical connection with the other via the printed circuit board;

a switch mounted to the printed circuit board for selective operation of two of said first, second and third connectors at one time, and a locking member mounted to the housing and equipped with a stopper member urged by a resilient member to lock said third connector when said third connector is located in the first position, wherein said third connector is equipped with a spring member urging said connector to be exposed to the exterior in the second position when the third connector is released from the stopper member;

one of said connectors is an audio connector.

16. The electronic assembly as claimed in claim 15, wherein said third connector is rotatable with regard to the case about an axis located at a comer of said case.

17. The electronic assembly as claimed in claim 16, wherein said locking member is accessible from the exterior so as to release said third connector from the first position to the second position.

18. The electronic assembly as claimed in claim 15, wherein said first side and said third side are longer than the second side.

* * * * *